US009074425B2

(12) United States Patent
Feasey

(10) Patent No.: US 9,074,425 B2
(45) Date of Patent: Jul. 7, 2015

(54) RISER AUXILIARY LINE JUMPER SYSTEM FOR ROTATING CONTROL DEVICE

(71) Applicant: Weatherford Technology Holdings, LLC, Houston, TX (US)

(72) Inventor: Guy F. Feasey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/106,050

(22) Filed: Dec. 13, 2013

(65) Prior Publication Data

US 2014/0178155 A1 Jun. 26, 2014

Related U.S. Application Data

(60) Provisional application No. 61/740,839, filed on Dec. 21, 2012.

(51) Int. Cl.

| | |
|---|---|
| ***E21B 19/00*** | (2006.01) |
| ***E21B 33/08*** | (2006.01) |
| ***E21B 21/08*** | (2006.01) |
| *E21B 21/00* | (2006.01) |

(52) U.S. Cl.

CPC ..... *E21B 19/004* (2013.01); *E21B 33/085* (2013.01); *E21B 21/08* (2013.01); *E21B 2021/006* (2013.01)

(58) Field of Classification Search

CPC .... E21B 19/004; E21B 19/006; E21B 33/085
USPC ..... 166/345, 358, 360, 367; 405/224.2, 405/224.4; 414/137.5, 803
See application file for complete search history.

(56) References Cited

U.S. PATENT DOCUMENTS

| | | | | | |
|---|---|---|---|---|---|
| 4,573,714 | A * | 3/1986 | Sweeney | 285/363 |
| 4,712,620 | A * | 12/1987 | Lim et al. | 166/355 |
| 5,046,896 | A * | 9/1991 | Cole | 405/195.1 |
| 5,875,848 | A * | 3/1999 | Wolff et al. | 166/345 |
| 6,102,673 | A * | 8/2000 | Mott et al. | 417/392 |
| 6,230,824 | B1 * | 5/2001 | Peterman et al. | 175/214 |
| 6,325,159 | B1 * | 12/2001 | Peterman et al. | 175/7 |
| 7,159,669 | B2 * | 1/2007 | Bourgoyne et al. | 166/382 |
| 7,328,741 | B2 | 2/2008 | Allen et al. | |
| 7,571,772 | B2 | 8/2009 | Reams | |
| 7,658,228 | B2 * | 2/2010 | Moksvold | 166/345 |
| 7,699,109 | B2 * | 4/2010 | May et al. | 166/367 |
| 8,403,059 | B2 * | 3/2013 | Hughes et al. | 166/367 |

(Continued)

FOREIGN PATENT DOCUMENTS

WO 2012076520 A2 6/2012

OTHER PUBLICATIONS

Aker Solutions—Deep water CLIP Riser for marine drilling operations, brochure, Jul. 15, 2010, 16 page.

(Continued)

*Primary Examiner* — Matthew Buck
(74) *Attorney, Agent, or Firm* — Patterson & Sheridan, L.L.P.

(57) ABSTRACT

A method for deploying a marine riser includes: assembling a rotating control device (RCD) spool with the marine riser; lowering the RCD spool through a rotary table of a drilling rig and into a moonpool of an offshore drilling unit; connecting a hose to an upper and lower adapter of the RCD spool in the moonpool; and lowering the RCD spool and the connected hose through the moonpool.

20 Claims, 7 Drawing Sheets

(56) References Cited

U.S. PATENT DOCUMENTS

| | | | | |
|---|---|---|---|---|
| 8,783,359 | B2 * | 7/2014 | Reed | 166/357 |
| 2010/0175882 | A1 * | 7/2010 | Bailey et al. | 166/335 |
| 2012/0073113 | A1 * | 3/2012 | Leduc et al. | 29/525.11 |

OTHER PUBLICATIONS

Sub Sea Services, "ROPS-System—Leading Technology for Subsea Operations", date unknown, 1 page.
WTF RCD Slide, printed Dec. 17, 2013, 1 page.
PCT International Search Report and Written Opinion for Application PCT/US2013/075738, dated Feb. 2, 2015.
Steve Nas, "A Legend Embraces Deepwater MPD Technology in Indonesia", By Hart Energy, dated Feb. 2011, 2 pages.
John Cohen et al., Papers from IADC UBO & MPD Committee Meeting in Milan, Italy, First Quarter Meeting Date Mar. 22-23, 2012, 9 pages.
Julmar Shaun S. Toralde: "Riser gas risk mitigation on a drillship uses closed-loop circulation drilling systems", dated May 2012, 2 pages.
Julmar Shaun S. Toralde: "RCD for DP drillship takes MPD deeper", Drilling Contractor, Jul. 14, 2011.
Steve Nas, SPE 132049 Article, "Deepwater Managed Pressure Drilling Applications", 2010, 9 pages.
Steve Nas et al., SPE/IADC 119875 Article, "Offshore Managed Pressure Drilling Experiences in Asia Pacific", 2009, 13 pages.

* cited by examiner

RISER AUXILIARY LINE JUMPER SYSTEM FOR ROTATING CONTROL DEVICE

BACKGROUND OF THE INVENTION

1. Field of the Invention

The present invention generally relates to a riser auxiliary line jumper system for a rotating control device.

2. Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water offshore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide means for lowering equipment (such as a drill string carrying a drill bit) into the hole.

SUMMARY OF THE INVENTION

The present invention generally relates to a riser auxiliary line jumper system for a rotating control device. In one embodiment, a method for deploying a marine riser includes: assembling a rotating control device (RCD) spool with the marine riser; lowering the RCD spool through a rotary table of a drilling rig and into a moonpool of an offshore drilling unit; connecting a hose to an upper and lower adapter of the RCD spool in the moonpool; and lowering the RCD spool and the connected hose through the moonpool.

In another embodiment, a jumper system for assembling a marine riser includes a rotating control device (RCD) spool having: an RCD housing; an upper adapter connected to the RCD housing and having a hose nipple; and a lower adapter connected to the RCD housing and having a hose nipple. The system further includes a jumper spool having: a hose; an upper latch connected to the hose and operable to engage the upper adapter nipple; and a lower latch connected to the hose and operable to engage the lower adapter nipple.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
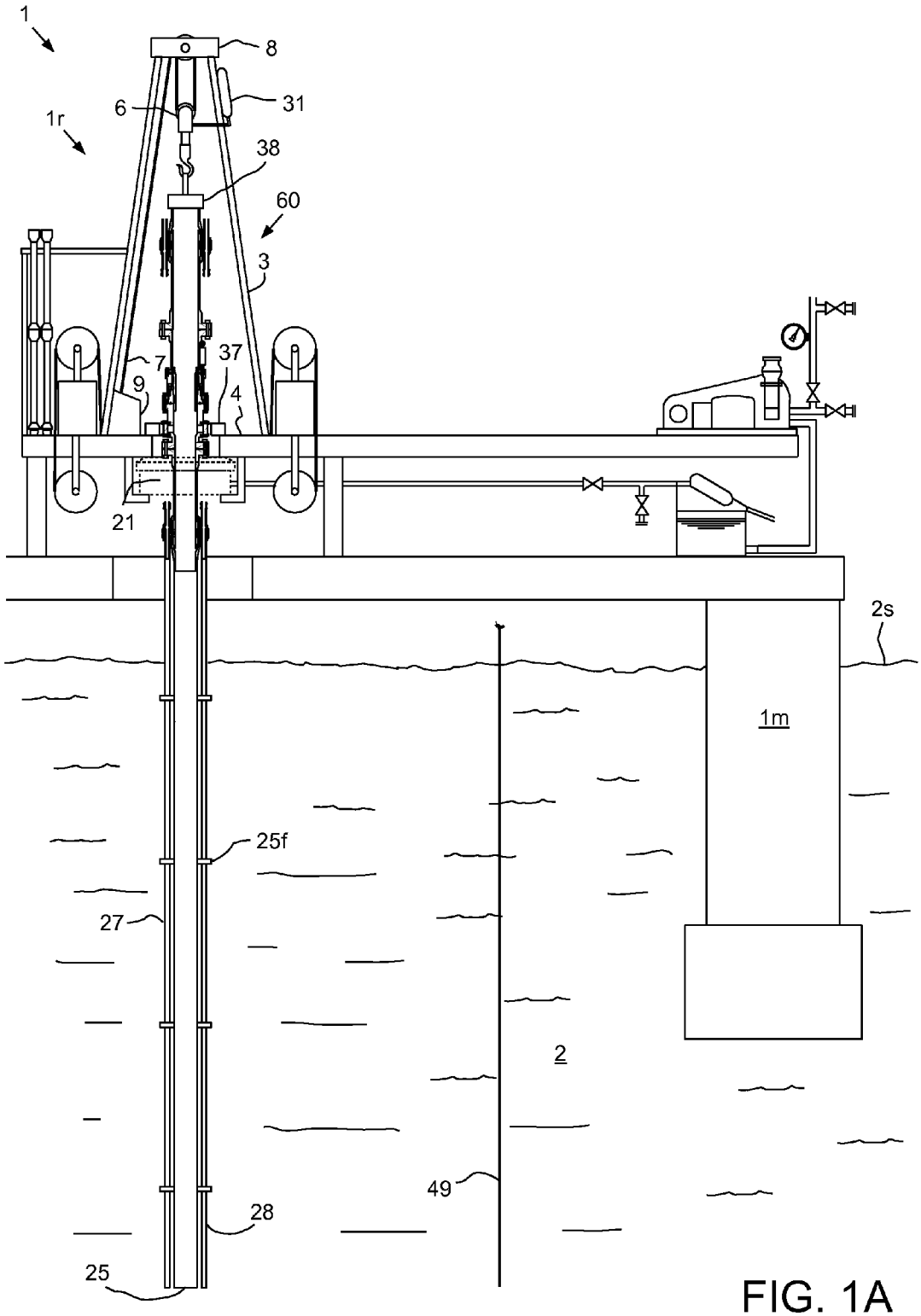
FIGS. 1A-1C illustrate an offshore drilling system in a riser deployment mode, according to one embodiment of the present invention.
Figure 1B:
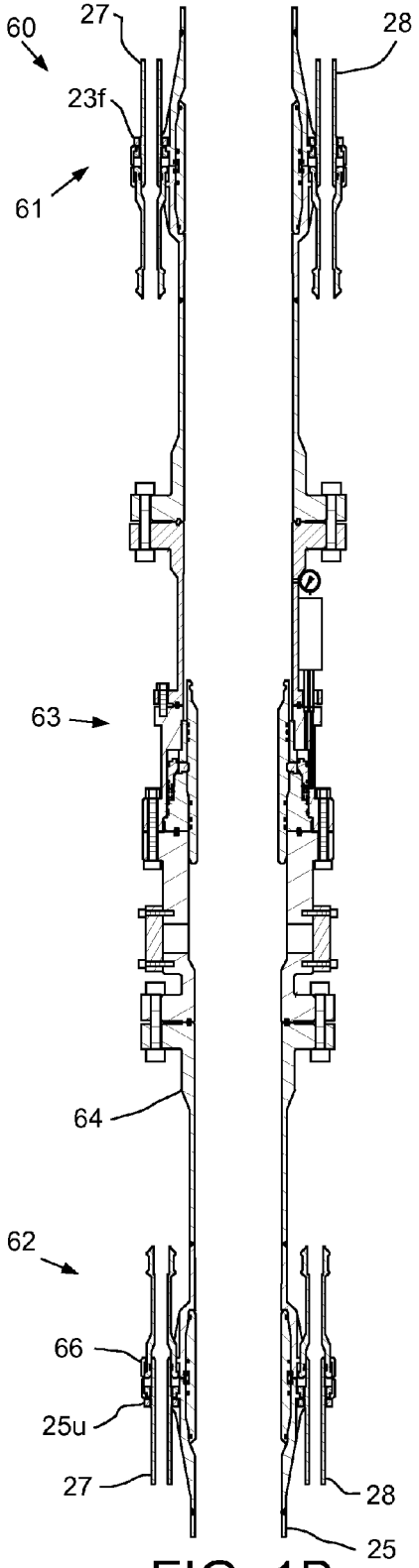
Figure 1C:
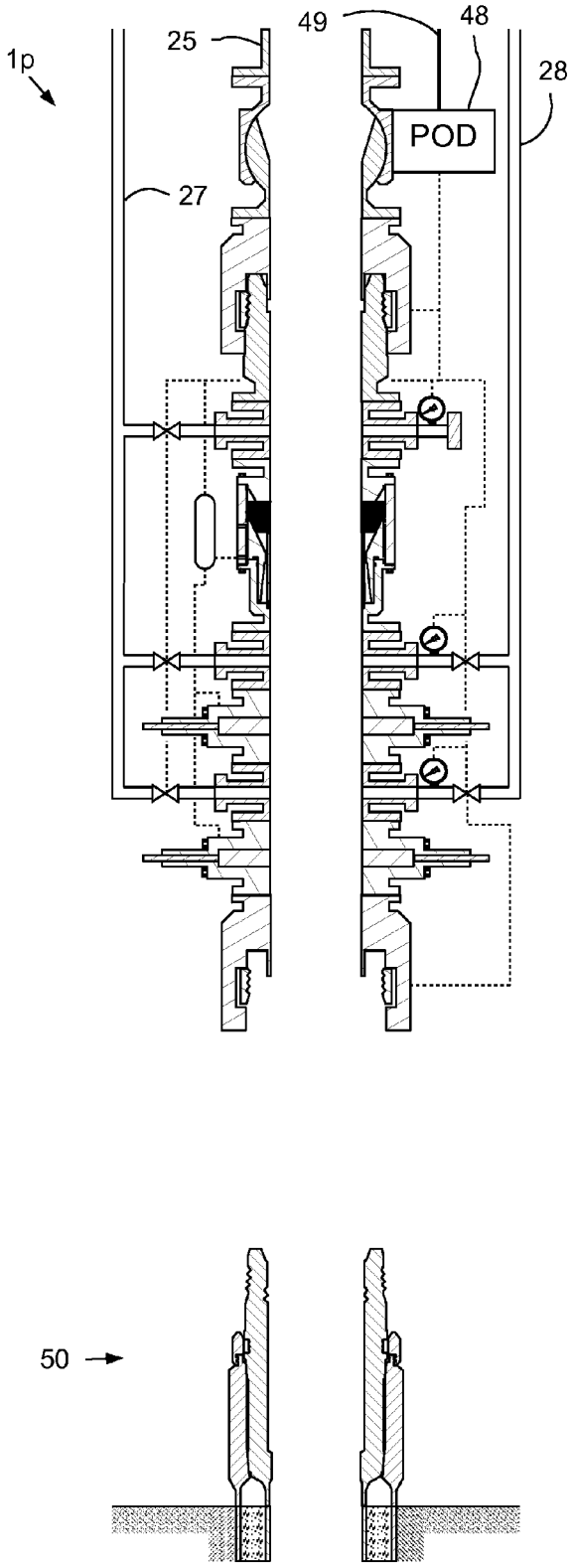

FIGS. 1A-1C illustrate an offshore drilling system 1 in a riser deployment mode, according to one embodiment of the present invention.

The drilling system 1 may include a mobile offshore drilling unit (MODU) 1*m*, such as a semi-submersible, a drilling rig 1*r*, a fluid handling system 1*h* (only partially shown, see FIG. 3A), a fluid transport system 1*t* (only partially shown, see FIGS. 3A-3C), and a pressure control assembly (PCA) 1*p*. The MODU 1*m* may carry the drilling rig 1*r* and the fluid handling system 1*h* aboard and may include a moon pool, through which operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*.

The drilling rig 1*r* may include a derrick 3 having a rig floor 4 at its lower end having an opening corresponding to the moonpool. The rig 1*r* may further include a traveling block 6 be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. A running tool 38 may be connected to the traveling block 6, such as by a rig compensator 31. Alternatively, the rig compensator may be disposed between the crown block 8 and the derrick 3.

Figure 3A:
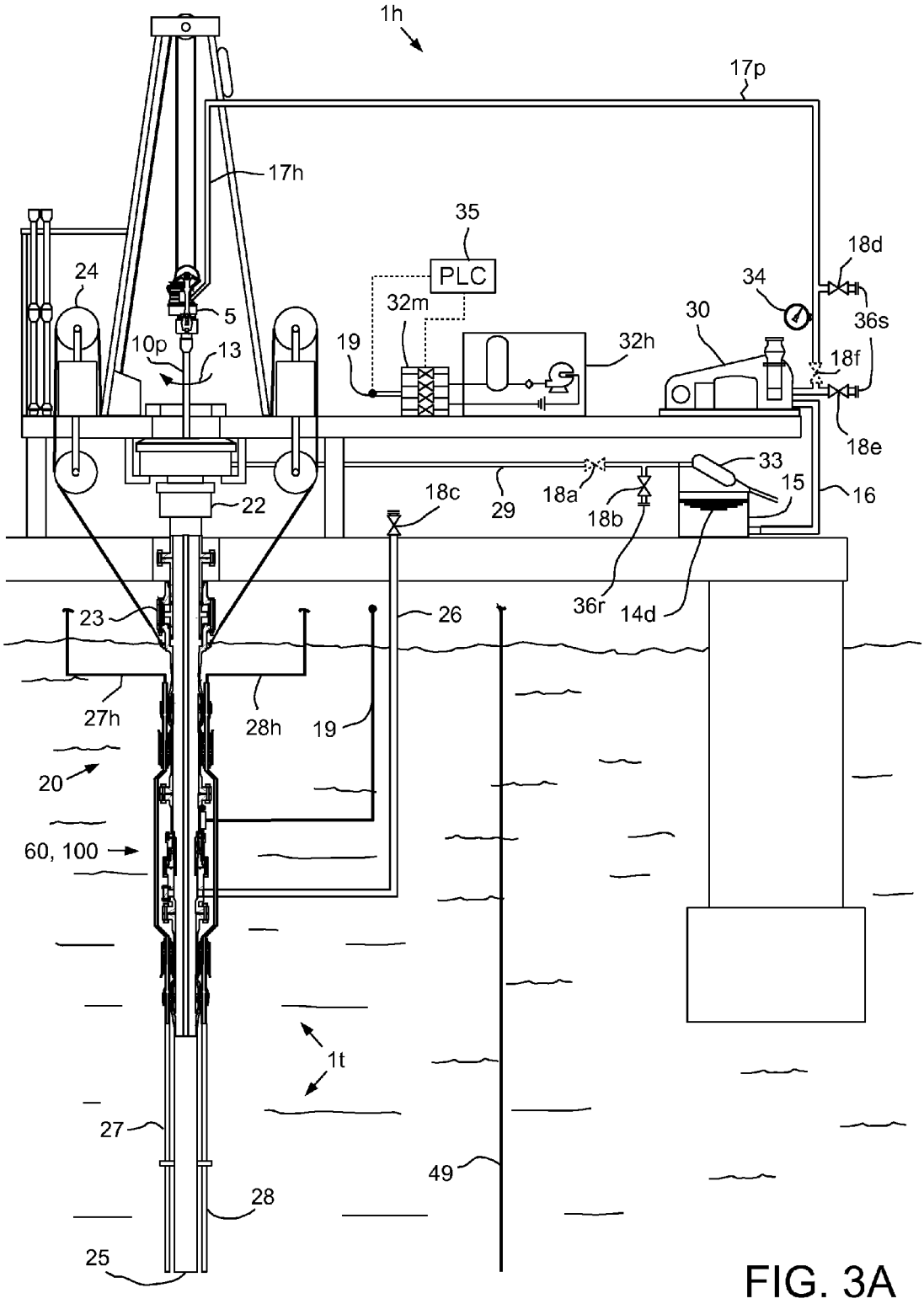
FIGS. 3A-3C illustrate the offshore drilling system in an overbalanced drilling mode.
Figure 3B:
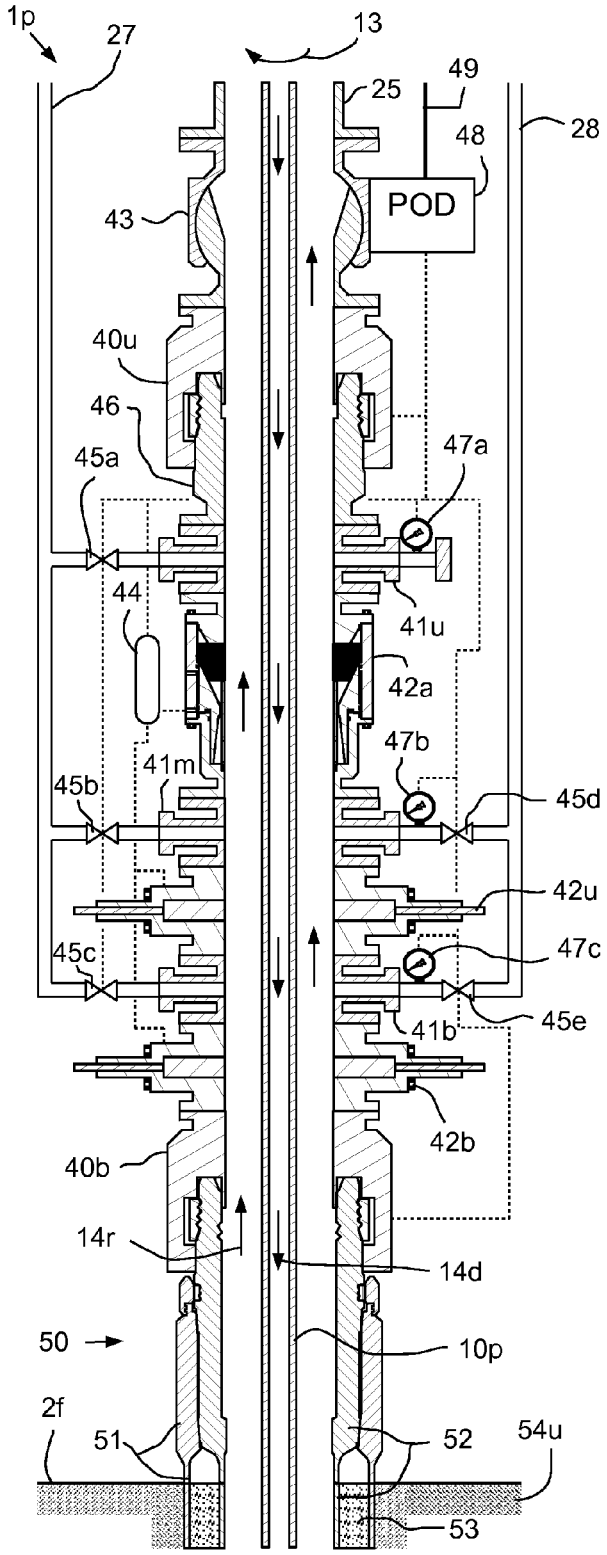
Figure 3C:
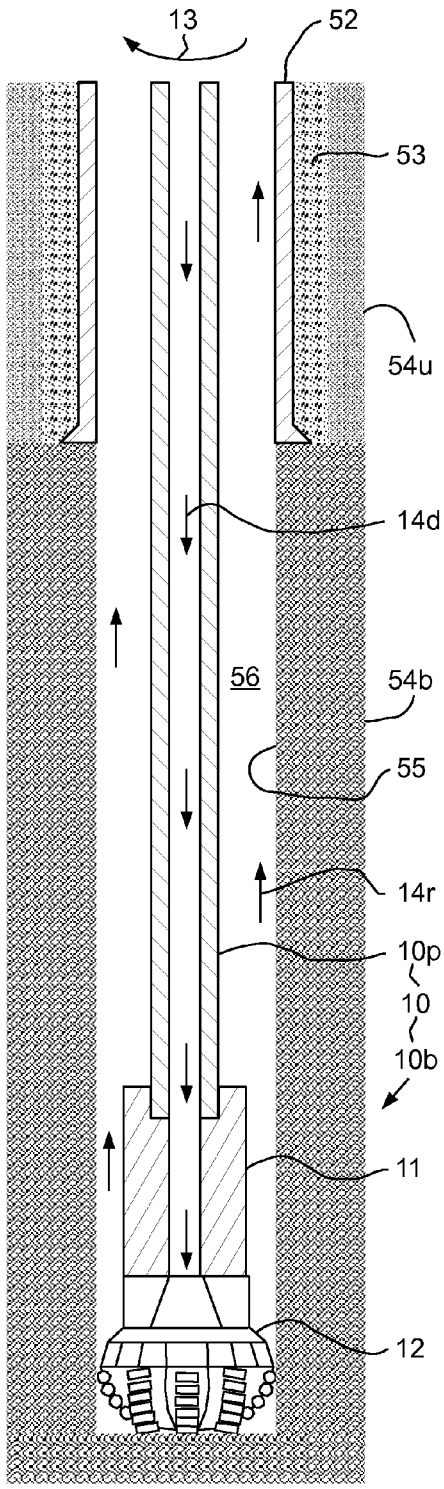

The fluid transport system 1*t* may include an upper marine riser package (UMRP) 20 (only partially shown, see FIG. 3A), a marine riser 25, one or more auxiliary lines 27, 28, such as a booster line 27 and a choke line 28, and a drill string 10 (in drilling mode, see FIGS. 3A-3C). Additionally, the auxiliary lines 27, 28 may further include a kill line (not shown) and/or one or more hydraulic lines. During deployment, the PCA 1*p* may be connected to a wellhead 50 located adjacent to a floor 2*f* of the sea 2.

A conductor string 51 may be driven into the seafloor 2*f*. The conductor string 51 may include a housing and joints of conductor pipe connected together, such as by threaded connections. Once the conductor string 51 has been set, a subsea wellbore 55 may be drilled into the seafloor 2*f* and a casing string 52 may be deployed into the wellbore. The casing string 52 may include a wellhead housing and joints of casing connected together, such as by threaded connections. The wellhead housing may land in the conductor housing during deployment of the casing string 52. The casing string 52 may be cemented 53 into the wellbore 55. The casing string 52 may extend to a depth adjacent a bottom of an upper formation 54*u*. The upper formation 54*u* may be non-productive and a lower formation 54*b* may be a hydrocarbon-bearing reservoir. Alternatively, the lower formation 54*b* may be environmentally sensitive, such as an aquifer, or unstable. Although shown as vertical, the wellbore 55 may include a vertical portion and a deviated, such as horizontal, portion.

The PCA 1*p* may include a wellhead adapter 40*b*, one or more flow crosses 41*u,m,b*, one or more blow out preventers (BOPS) 42*a,u,b*, a lower marine riser package (LMRP), one or more accumulators 44, and a receiver 46. The LMRP may include a control pod 48, a flex joint 43, and a connector 40*u*. The wellhead adapter 40*b*, flow crosses 41*u,m,b*, BOPS 42*a, u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPS 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 48 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 48 may be in electric, hydraulic, and/or optical communication with a rig controller (not shown) onboard the MODU 1*m* via an umbilical 49. The control pod 48 may include one or more control valves (not shown) in communication with the BOPS 42*a,u,b* for operation thereof. Each control valve may include an electric or hydraulic actuator in communication with the umbilical 49. The umbilical 49 may include one or more hydraulic or electric control conduit/cables for the actuators. The accumulators 44 may store pressurized hydraulic fluid for operating the BOPS 42*a,u,b*. Additionally, the accumulators 44 may be used for operating one or more of the other components of the PCA 1*p*. The umbilical 49 may further include hydraulic, electric, and/or optic control conduit/cables for operating various functions of the PCA 1*p*. The rig controller may operate the PCA 1*p* via the umbilical 49 and the control pod 48.

A lower end of the booster line 27 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, the kill line may be connected to the branches of the flow crosses 41*m,b* instead of the booster manifold. An upper end of the booster line 27 may be connected to an outlet of a booster pump (not shown) and an upper end of the choke line may be connected to a rig choke (not shown). A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 48. The lines 27, 28 and may extend between the MODU 1*m* and the PCA 1*p* by being fastened to flanged connections 25*f* between joints of the riser 25. The umbilical 49 may also extend between the MODU 1*m* and the PCA 1*p*. Each shutoff valve 45*a-e* may be automated and have a hydraulic actuator (not shown) operable by the control pod 48 via fluid communication with a respective umbilical conduit or the LMRP accumulators 44. Alternatively, the valve actuators may be electrical or pneumatic.

Once deployed, the riser 25 may extend from the PCA 1*p* to the MODU 1*m* and may connect to the MODU via the UMRP 20. The UMRP 20 may include a diverter 21 (only housing shown), a flex joint 22, a slip (aka telescopic) joint 23, a tensioner 24, and a rotating control device (RCD) spool 60. A lower end of the RCD spool 60 may be connected to an upper end of the riser 25, such as by a flanged connection. The slip joint 23 may include an outer barrel connected to an upper end of the RCD spool 60, such as by a flanged connection, and an inner barrel connected to the flex joint 22, such as by a flanged connection. The outer barrel may also be connected to the tensioner 24, such as by a tensioner ring, and may further include a termination ring for connecting upper ends of the lines 27, 28 to respective hoses 27*h*, 28*h* leading to the MODU 1*m*.

The flex joint 22 may also connect to a mandrel of the diverter 21, such as by a flanged connection. The diverter mandrel may be hung from the diverter housing during deployment of the riser 25. The diverter housing may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

In operation, a lower portion of the riser 25 may be assembled using the running tool 38 and a riser spider (not shown). The riser 25 may be lowered through a rotary table 37 located on the rig floor 4. A lower end of the riser 25 may then be connected to the PCA 1*p* in the moonpool. The PCA 1*p* may be lowered through the moonpool by assembling joints of the riser 25 using the flanges 25*f*. Once the PCA 1*p* nears the wellhead 50, the RCD spool 60 may be connected to an upper end of the riser 25 using the running tool 38 and spider. The RCD spool 60 may then be lowered through the rotary table 37 into the moonpool. A jumper spool 100 may then be installed on the RCD spool 60 in the moonpool. The spools 60, 100 may then be lowered through the moonpool by assembling the other UMRP components (slip joint locked). The diverter mandrel may be landed into the diverter housing and the tensioner 24 connected to the tensioner ring. The tensioner 24 and slip joint 23 may then be operated to land the PCA 1*p* onto the wellhead 50 and the PCA latched to the wellhead.

The pod 48 and umbilical 49 may be deployed with the PCA 1*p* as shown. Alternatively, the pod 48 may be deployed in a separate step after the riser deployment operation. In this alternative, the pod 48 may be lowered to the PCA 1*p* using the umbilical 49 and then latched to a receptacle (not shown) of the LMRP.

FIGS. 2A-2D illustrate the jumper system 60, 100 and operation thereof. Referring also to FIG. 1B, the jumper system 60, 100 may include the RCD spool 60 and the jumper spool 100. The RCD spool 60 may include an upper adapter 61, a lower adapter 62, and an RCD 63 connected between the adapters, such as by flanged connections.

Figure 4:
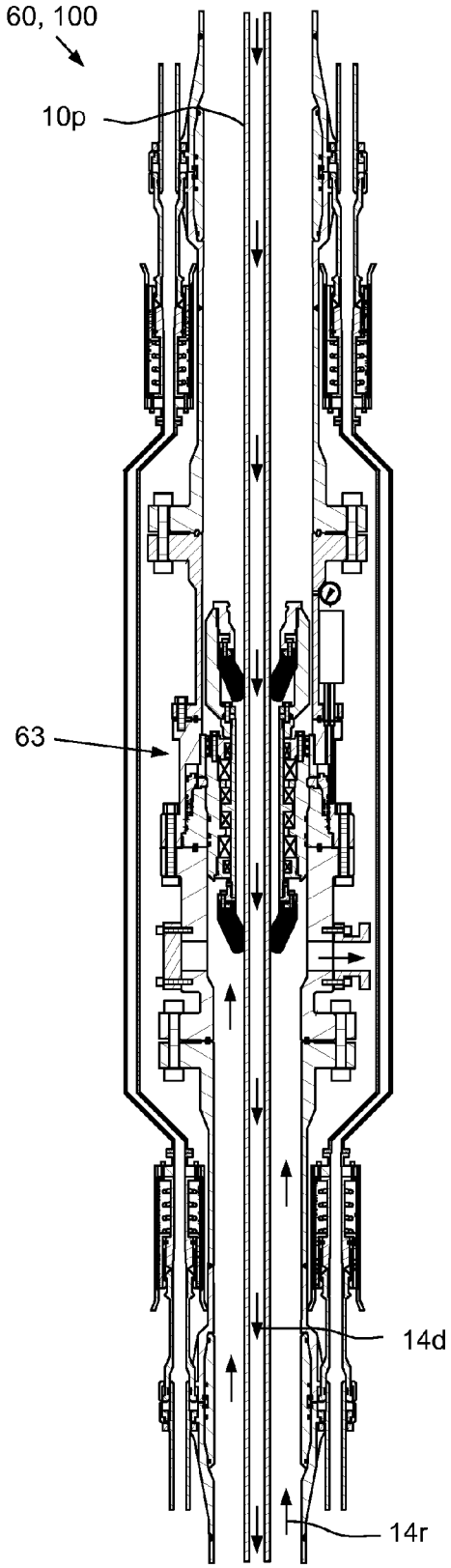
FIG. 4 illustrates the offshore drilling system in a managed pressure drilling mode.

The RCD 63 may be convertible between an idle mode (FIGS. 1B and 2D) and an operating mode (FIG. 4). The RCD 63 may include a housing, a piston, a latch, a protector sleeve (idle mode) and a bearing assembly (operating mode). The RCD housing may be tubular and have one or more sections connected together, such as by flanged connections. The bearing assembly may include a bearing pack, a housing seal assembly, one or more strippers, and a catch sleeve. The bearing assembly may be selectively longitudinally and torsionally connected to the housing by engagement of the latch with the catch sleeve. The housing may have hydraulic ports in fluid communication with the piston and an interface of the RCD 63. The bearing pack may support the strippers from the sleeve such that the strippers may rotate relative to the housing (and the sleeve). The bearing pack may include one or more radial bearings, one or more thrust bearings, and a self contained lubricant system. The bearing pack may be disposed between the strippers and be housed in and connected to the catch sleeve, such as by a threaded connection and/or fasteners.

Each stripper may include a gland or retainer and a seal. Each stripper seal may be directional and oriented to seal against drill pipe 10*p* in response to higher pressure in the riser 25 than the UMRP 20. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the bearing assembly so that the stripper seals may engage the drill pipe. The stripper seals may provide a desired barrier in the riser 25 either when the drill pipe 10*p* is stationary or rotating. Once deployed, the RCD 63 may be submerged adjacent the waterline 2*s*. The RCD interface may be in fluid communication with a hydraulic power unit (HPU) 32*h* (FIG. 3A) and a programmable logic controller (PLC) 35 via an RCD umbilical 19.

Alternatively, an active seal RCD may be used. Alternatively, the RCD 63 may be located above the waterline 2*s* and/or along the UMRP 20 at any other location besides a lower end thereof. Alternatively, the RCD 63 may be assembled as part of the riser 25 at any location therealong or as part of the PCA 1*p*.

The lower adapter 62 may be tubular and include an upper flange 64, a lower flange 66, and a body 65 connecting the flanges. The upper flange 64 may mate with a lower flange of the RCD 63, thereby connecting the two components. The lower flange 66 may mate with an upper flange 25*u* of the riser 25, thereby connecting the two components. Each flange 64, 66 may have a respective neck portion 64*n*, 66*n* and rim portion 64*r*, 66*r*. The upper flange rim portion 64*r* may have holes formed therethrough and spaced therearound for receiving fasteners, such as bolts or studs and nuts. The upper flange rim portion 64*r* may further have a seal face formed in an upper surface thereof for receiving a gasket.

The lower flange rim portion 66*r* may have sockets and holes (not shown) formed therethrough and spaced therearound in an alternating fashion. The lower flange holes may receive fasteners, such as bolts or studs and nuts. Each lower flange socket may receive a collar 67*c* of a respective hose nipple 67. The lower flange rim portion 66*r* may have a socket for each auxiliary line 27, 28. Each collar 67*c* may have a shoulder formed in a lower end thereof and each socket be oversized and have a shoulder formed at an upper end thereof, thereby trapping the collar 67*c* while allowing longitudinal play of the collar. Each collar 67*c* may carry one or more seals on an inner surface thereof for receiving a coupling of the respective auxiliary line 27, 28. The interface between the lower flange 66 and the upper riser flange 25*u* may be sealed by a seal sleeve 68 carrying one or more seals for each flange along an outer surface thereof. The lower flange neck 66*n* may have a recess formed in a lower end thereof and a neck of the upper riser flange may have a corresponding recess for receiving the seal sleeve 68 and trapping the sleeve between shoulders of the recesses.

Each hose nipple 67 may further have a catch 67*h* formed at an upper portion thereof and a body 67*b* connecting the catch and the collar 67*c*. The catch 67*h* may have a latch profile 67*p* formed in an outer surface thereof and a recessed seal bore 67*r* formed in an inner surface thereof. The upper adapter 61 may be similar to the lower adapter 62 except for being inverted and scaled to mate with an upper flange of the RCD 63 and with a lower flange 23*f* of the slip joint 23.

The jumper spool 100 may include upper 101 and lower 102 latches for each auxiliary line 27, 28, a frame 103, a linear actuator 104-106, a hose 127, 128 for each auxiliary line 27, 28, a microcontroller 107, a junction 108, and a lifting lug 111. The linear actuator 104-106 may include a slider 104, a lead screw 105, and a submersible electric motor 106. The linear actuator 104-106, lower latches 102, microcontroller 107, a junction 108, a lifting lug 111 may each be connected to the frame 103, such as by fastening (not shown). The frame 103 may be annular and have a passage (not shown) formed therein and sized to receive the RCD spool 60 such that the jumper spool 100 may be radially inserted around the RCD spool.

The slider 104 may be transversely connected to the frame 103 with freedom to move longitudinally relative thereto. The upper latch 101 may be connected to the slider 104, such as by fastening (not shown). An upper end of each hose 127, 128 may be connected to the respective upper latch 101, such as by a flanged connection, and a lower end of each hose 127, 128 may be connected to the respective lower latch 102, such as by a flanged connection. Each hose 127, 128 may be made from a flexible polymer material, such as a thermoplastic or elastomer, or may be a metal or alloy bellows. Each hose 127, 128 may or may not be reinforced, such as by metal or alloy cords. The microcontroller 107 may be in electrical communication with the motor 106, the junction 108, the upper latch 101, and the lower latch 102 via respective submersible cables 110*a*-*d*.

Each lower latch 102 may include a housing 115, a mandrel 116, a fastener, such as collet 119*b*,*f*, and a linear actuator 117, 118, 120. The linear actuator 117, 118, 120 may include a lock 117, a spring 118 and a solenoid 120. The housing 115 may have a skirt 115*s*, a flange 115*f*, and a head 115*h* connecting the skirt and the flange. The mandrel 116 may have a stinger 116*s*, a body 116*b*, a shoulder 116*h* connecting the stinger and the body, and a flange 116*f* formed at an upper end thereof extending from the body. The mandrel 116 may be disposed in the skirt 115*s* and have sockets formed in the flange 116*f* for receiving fasteners extending through holes formed through the head 115*h*, thereby connecting the mandrel and the housing 115. The housing 115 may have a bore formed through the flange 115*f* and the head 115*h* and the mandrel 116 may have a bore formed therethrough corresponding to the housing bore, thereby forming a flow bore through the lower latch 102. The stinger 116*s* may carry a seal on an outer surface thereof.

The collet 119*b,f* may be disposed around the mandrel 116 and connected to the mandrel shoulder 116*h*, such as by a shearable connection including one or more shear screws. The collet 119*b,f* may include a base 119*b* and a plurality of split fingers 119*f* extending from the base. The fingers 225*f* may have lugs formed at an end distal from the base and be naturally biased toward a retracted position (shown).

Figure 2A:
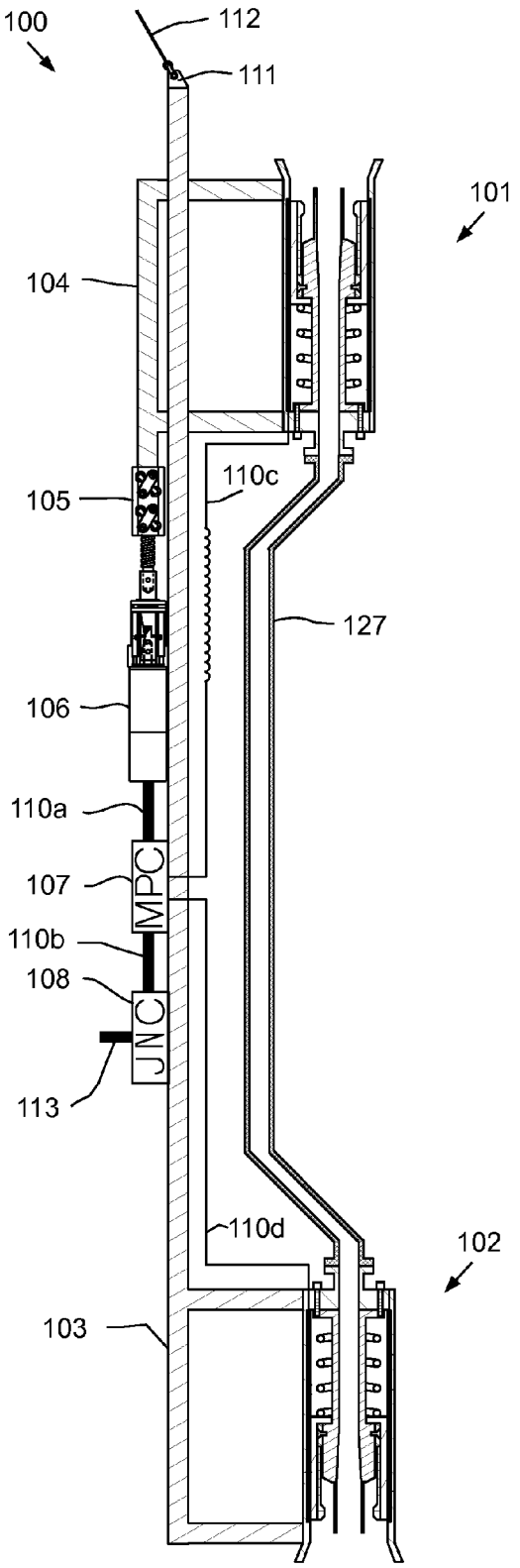
FIGS. 2A-2D illustrate the jumper system and operation thereof.
Figure 2B:
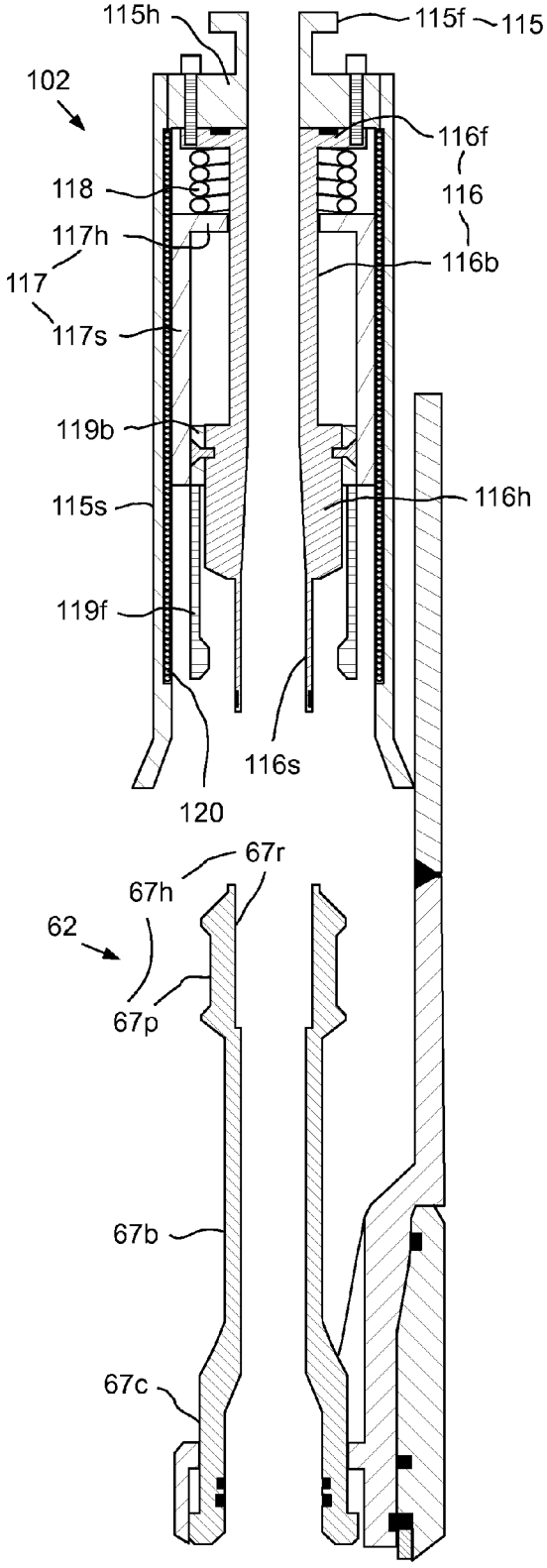
Figure 2C:
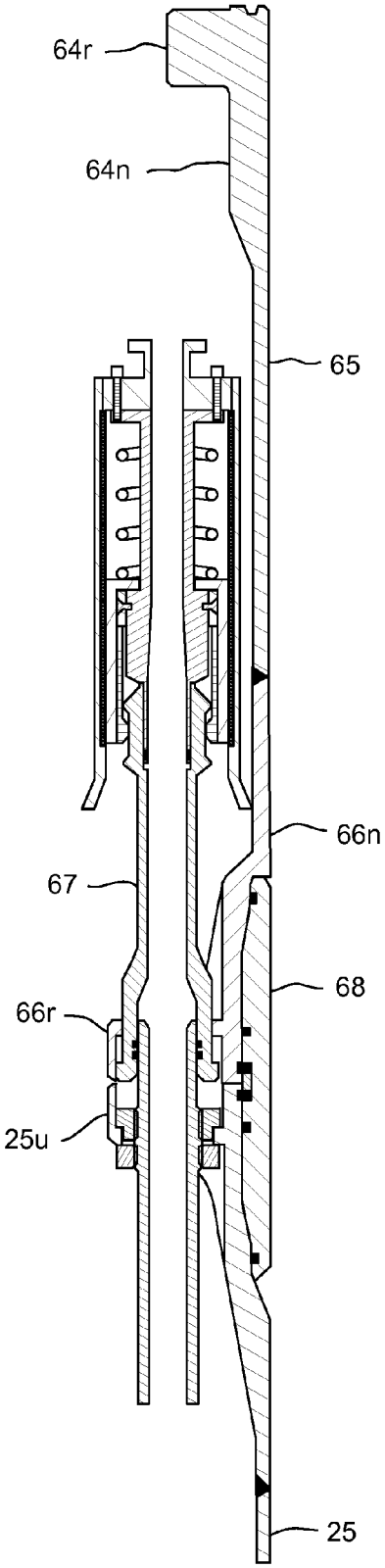
Figure 2D:
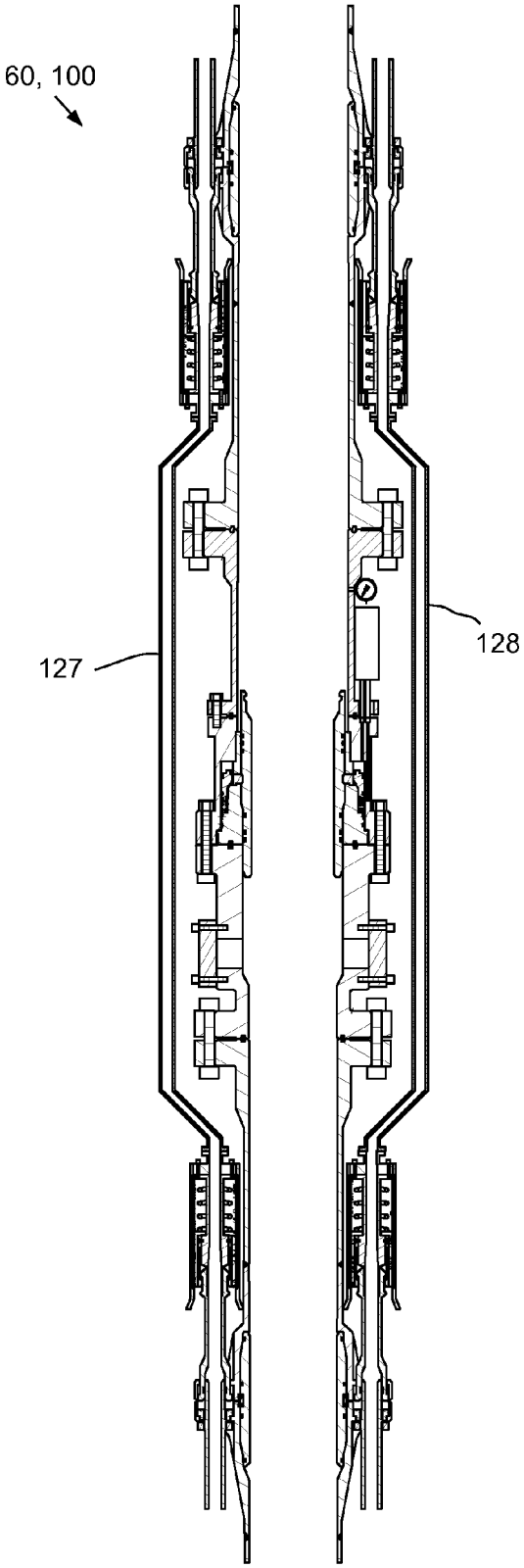

The lock 117 may have a shoulder 117*h* formed at an upper end thereof and a sleeve 117*s* extending from the shoulder. The lock 117 may be longitudinally movable relative to the housing 115 and mandrel 116 between a locked position (FIGS. 2A, 2C) and an unlocked position (FIG. 2B). The spring 118 may be disposed between the mandrel flange 116*f* and the lock shoulder 117*h* and may bias the lock 117 toward the locked position. The lock shoulder 117*h* may engage the mandrel shoulder 116*h* in the locked position. The lock sleeve 117*s* may engage an outer surface of the collet fingers 119*f* in the locked position, thereby preventing expansion of the fingers. The lock 117 may be made from a magnetic material and be pushed upward in response to electrification of the solenoid 120 by the microcontroller 107 until the lock sleeve 117*s* is clear of the fingers 119*f*, thereby unlocking the fingers. Shutting off the solenoid 120 by the microcontroller 107 may allow the spring 118 to return the lock 117 to the locked position. A top of the nipple catch 67*h* may form a landing seat for receiving a mating landing seat formed in a bottom of the mandrel shoulder 116*h*, thereby supporting the jumper spool 100 from the lower adapter 62.

Additionally, a target (not shown) may be embedded (i.e., bonded or press fit) in an upper surface of the nipple catch 67*h* and a proximity sensor (not shown) may be disposed in a lower surface of the mandrel shoulder 116*h*. The target may be a ring made from a magnetic material or permanent magnet. The nipple 67 may be made from the diamagnetic or paramagnetic material. The proximity sensor may or may not include a biasing magnet depending on whether the target is a permanent magnet. The proximity sensor may include a semiconductor and may be in electrical communication with the microcontroller for receiving a regulated current. The proximity sensor and/or target may be oriented so that the magnetic field generated by the biasing magnet/permanent magnet target is perpendicular to the current. The proximity sensor may further include an amplifier for amplifying the Hall voltage output by the semiconductor when the target is in proximity to the sensor. Alternatively, the proximity sensors may be inductive, capacitive, or utilize radio frequency identification tags (RFID).

The upper latches 101 may be similar to the lower latches 102 except for being inverted.

In operation, once the RCD spool 60 has been inserted into the moonpool through the rotary table 37, a lift line 112 located in the moonpool may be connected to the lifting lug 111 and a power line 113 located in the moonpool may be connected to the junction 107. The power line 113 may also accommodate data communication between a service technician and the microcontroller. The technician may instruct the microcontroller 107 to prepare for installation of the jumper spool 100. The microcontroller 107 may respond by unlocking the upper 101 and lower 102 latches. A winch connected to the lift line 112 may be operated to hoist the jumper spool 100. The technician may guide the jumper spool 100 onto the RCD spool 60 and orient the jumper spool 100 so that the latches 101, 102 are aligned with the respective nipple pairs. The winch may then be operated to lower the lower latches 102 onto the lower adapter 62.

As the lower latches 102 engage the respective lower nipples 67, the stinger 116*s* may engage the seal bore 67*r* and a first chamfered surface of the finger lugs may engage a chamfered surface of the respective latch profiles 67*p*, thereby pushing the fingers 119*f* radially outward. Lowering may continue until the finger lugs are aligned with a groove of the profile 67*p*, thereby allowing stiffness of the fingers 119*f* to return the fingers to their natural position. Lowering may continue until the landing seat of each mandrel 116 engages the landing seat of the respective nipple catch 67*h*. The microcontroller 107 may then lock the lower latches 102 and supply electricity to the motor 106 at a first polarity. A shaft of the lead screw 105 may be torsionally connected to a rotor of the motor 106. The motor 106 may rotate the rotor and the shaft, thereby driving the slider 104 upward and pushing the upper latches 101 into engagement with the upper adapter 61 until the mandrels have seated against the respective upper nipples. The microcontroller 107 may then lock the upper latches 101 and shut down the motor 106. The motor 106 may be reversible to disconnect the upper latches 101 from the upper adapter 61. The technician may then disconnect the power line 113 and lifting line 112 from the jumper spool 100.

Deployment of the riser 25 may then continue. Once the termination joint reaches the moonpool, hoses 27*h*, 28*h* may be connected to respective auxiliary line ports of the termination joint, thereby connecting the auxiliary lines 27, 28 to the respective booster pump and rig choke.

Alternatively, the jumper spool 100 may be deployed using a pipe handler arm (not shown) to eliminate manual handling of the jumper spool. Alternatively, the lifting line 112 and power line 113 may be combined into a wireline. Alternatively, the lifting line 112 may carry a battery pack for wired or wireless engagement with the junction 108 instead of using the power line 113. Alternatively, the upper latches 101 and upper adapter nipples may each be gooseneck-shaped to eliminate the linear actuator 104-106. Alternatively, the linear actuator 104-106 may be replaced by a hydraulically powered piston and cylinder assembly and the power line 113 replaced by one or more hydraulic hoses and/or each lock 117 may be a piston and a hydraulic hose may replace each of the cables 110*c,d*, thereby obviating the need for the solenoid 120.

FIGS. 3A-3C illustrate the offshore drilling system 1 in an overbalanced drilling mode. Once the riser 25, PCA 1*p*, and UMRP 20 have been deployed, drilling of the lower formation 54*b* may commence. The running tool 38 may be replaced by a top drive 5 and a fluid handling system 1*h* may be installed. The drill string 10 may be deployed into the wellbore 55 through the riser 25, PCA 1*p*, UMRP 20 and casing 52.

The drilling rig 1*r* may further include a rail (not shown) extending from the rig floor 4 toward the crown block 8. The top drive 5 may include an extender (not shown), motor, an inlet, a gear box, a swivel, a quill, a trolley (not shown), a pipe hoist (not shown), and a backup wrench (not shown). The top drive motor may be electric or hydraulic and have a rotor and stator. The motor may be operable to rotate the rotor relative to the stator which may also torsionally drive the quill via one or more gears (not shown) of the gear box. The quill may have a coupling (not shown), such as splines, formed at an upper end thereof and torsionally connecting the quill to a mating coupling of one of the gears. Housings of the motor, swivel, gear box, and backup wrench may be connected to one another, such as by fastening, so as to form a non-rotating frame. The top drive 5 may further include an interface (not shown) for receiving power and/or control lines.

The trolley may ride along the rail, thereby torsionally restraining the frame while allowing vertical movement of the top drive 5 with the travelling block. The traveling block may be connected to the frame via the rig compensator to suspend the top drive from the derrick 3. The swivel may include one or more bearings for longitudinally and rotationally supporting rotation of the quill relative to the frame. The inlet may have a coupling for connection to a Kelly hose 17*h* and provide fluid communication between the Kelly hose and a bore of the quill. The quill may have a coupling, such as a threaded pin, formed at a lower end thereof for connection to a mating coupling, such as a threaded box, at a top of the drill string 10.

The drill string 10 may include a bottomhole assembly (BHA) 10*b* and joints of drill pipe 10*p* connected together, such as by threaded couplings. The BHA 10*b* may be connected to the drill pipe 10*p*, such as by a threaded connection, and include a drill bit 12 and one or more drill collars 11 connected thereto, such as by a threaded connection. The drill bit 12 may be rotated 13 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The fluid handling system 1*h* may include a fluid tank 15, a supply line 17*p,h*, one or more shutoff valves 18*a-f*, an RCD return line 26, a diverter return line 29, a mud pump 30, a hydraulic power unit (HPU) 32*h*, a hydraulic manifold 32*m*, a cuttings separator, such as shale shaker 33, a pressure gauge 34, the programmable logic controller (PLC) 35, a return bypass spool 36*r*, a supply bypass spool 36*s*. A first end of the return line 29 may be connected to an outlet of the diverter 21 and a second end of the return line may be connected to the inlet of the shaker 33. A lower end of the RCD return line 19 may be connected to an outlet of the RCD 63 and an upper end of the return line may have shutoff valve 18*c* and be blind flanged. An upper end of the return bypass spool 36*r* may be connected to the shaker inlet and a lower end of the return bypass spool may have shutoff valve 18*b* and be blind flanged. A transfer line 16 may connect an outlet of the fluid tank 15 to the inlet of the mud pump 30. A lower end of the supply line 17*p,h* may be connected to the outlet of the mud pump 30 and an upper end of the supply line may be connected to the top drive inlet. The pressure gauge 34 and supply shutoff valve 18*f* may be assembled as part of the supply line 17*p,h*. A first end of the supply bypass spool 36*s* may be connected to the outlet of the mud pump 30*d* and a second end of the bypass spool may be connected to the standpipe 17*p* and may each be blind flanged. The shutoff valves 18*d,e* may be assembled as part of the supply bypass spool 36*s*.

In the overbalanced drilling mode, the mud pump 30 may pump the drilling fluid 14*d* from the transfer line 16, through the pump outlet, standpipe 17*p* and Kelly hose 17*h* to the top drive 5. The drilling fluid 14*d* may flow from the Kelly hose 17*h* and into the drill string 10 via the top drive inlet. The drilling fluid 14*d* may flow down through the drill string 10 and exit the drill bit 12, where the fluid may circulate the cuttings away from the bit and carry the cuttings up the annulus 56 formed between an inner surface of the casing 52 or wellbore 55 and the outer surface of the drill string 10. The returns 14*r* may flow through the annulus 56 to the wellhead 50. The returns 14*r* may continue from the wellhead 50 and into the riser 25 via the PCA 1*p*. The returns 14*r* may flow up the riser 25 to the diverter 21. The returns 14*r* may flow into the diverter return line 29 via the diverter outlet. The returns 14*r* may continue through the diverter return line 29 to the shale shaker 33 and be processed thereby to remove the cuttings, thereby completing a cycle. As the drilling fluid 14*d* and returns 14*r* circulate, the drill string 10 may be rotated 13 by the top drive 5 and lowered by the traveling block, thereby extending the wellbore 55 into the lower formation.

The drilling fluid 14*d* may include a base liquid. The base liquid may be base oil, water, brine, or a water/oil emulsion. The base oil may be diesel, kerosene, naphtha, mineral oil, or synthetic oil. The drilling fluid 14*d* may further include solids dissolved or suspended in the base liquid, such as organophilic clay, lignite, and/or asphalt, thereby forming a mud.

FIG. 4 illustrates the offshore drilling system 1 in a managed pressure drilling mode. Should an unstable zone in the lower formation 54*b* be encountered, the drilling system 1 may be shifted into managed pressure mode.

To shift the drilling system 1, a managed pressure return spool (not shown) may be connected to the RCD return line 26 and the bypass return spool 36*r*. The managed pressure return spool may include a returns pressure sensor, a returns choke, a returns flow meter, and a gas detector. A managed pressure supply spool (not shown) may be connected to the supply bypass spool 36*s*. The managed pressure supply spool may include a supply pressure sensor and a supply flow meter. Each pressure sensor may be in data communication with the PLC 35. The returns pressure sensor may be operable to measure backpressure exerted by the returns choke. The supply pressure sensor may be operable to measure standpipe pressure.

The returns flow meter may be a mass flow meter, such as a Coriolis flow meter, and may be in data communication with the PLC 35. The returns flow meter may be connected in the spool downstream of the returns choke and may be operable to measure a flow rate of the returns 14*r*. The supply flow meter may be a volumetric flow meter, such as a Venturi flow meter. The supply flow meter may be operable to measure a flow rate of drilling fluid 14*d* supplied by the mud pump 30 to the drill string 10 via the top drive 5. The PLC 35 may receive a density measurement of the drilling fluid 14*d* from a mud blender (not shown) to determine a mass flow rate of the drilling fluid. The gas detector may include a probe having a membrane for sampling gas from the returns 14*r*, a gas chromatograph, and a carrier system for delivering the gas sample to the chromatograph. Alternatively, the supply flow meter may be a mass flow meter.

Additionally, a degassing spool (not shown) may be connected to a second return bypass spool (not shown). The degassing spool may include automated shutoff valves at each end and a mud-gas separator (MGS). A first end of the degassing spool may be connected to the return spool between the gas detector and the shaker 33 and a second end of the degasser spool may be connected to an inlet of the shaker. The MGS may include an inlet and a liquid outlet assembled as part of the degassing spool and a gas outlet connected to a flare or a gas storage vessel. The PLC 35 may utilize the flow meters to perform a mass balance between the drilling fluid and returns flow rates and activate the degassing spool in response to detecting a kick of formation fluid.

The RCD 63 may be shifted from idle mode to active mode by retrieving the protector sleeve and replacing the protector sleeve with the bearing assembly. Once the spools have been installed and the RCD has been shifted, drilling may recommence in the managed pressure mode. The RCD 63 may divert the returns 14*r* into the RCD return line 26 and through the managed pressure return spool to the shaker 33. During drilling, the PLC 35 may perform the mass balance and adjust the returns choke accordingly, such as tightening the choke in response to a kick and loosening the choke in response to loss of the returns. As part of the shift to managed pressure mode, a density of the drilling fluid 14*d* may be reduced to correspond to a pore pressure gradient of the lower formation 54*b*.

While the foregoing is directed to embodiments of the present invention, other and further embodiments of the invention may be devised without departing from the basic scope thereof, and the scope thereof is determined by the claims that follow.

The invention claimed is:

1. A method for deploying a marine riser, comprising:
assembling a rotating control device (RCD) spool with the marine riser;
lowering the RCD spool through a rotary table of a drilling rig and into a moonpool of an offshore drilling unit;
connecting a hose to an upper and lower adapter of the RCD spool in the moonpool; and
lowering the RCD spool and the connected hose through the moonpool,
wherein:
the hose is part of a jumper spool,
the hose is connected to the lower adapter by: hoisting the jumper spool, guiding the jumper spool onto the RCD spool, and lowering a lower latch of the jumper spool onto a hose nipple of the lower adapter, and
the hose is connected to the upper adapter by supplying power to the jumper spool, thereby operating a linear actuator thereof to push an upper latch of the jumper spool into engagement with a hose nipple of the upper adapter.

2. The method of claim 1,
further comprising assembling a slip joint, flex joint, and diverter mandrel with the marine riser, thereby forming an upper marine riser package (UMRP),
wherein the RCD spool is part of the UMRP.

3. The method of claim 2, wherein:
connection of the hose extends an auxiliary line extending along the marine riser, and
the UMRP has a termination ring receiving an upper end of the auxiliary line.

4. The method of claim 2, further comprising connecting a lower end of the riser to a pressure control assembly in the moonpool.

5. The method of claim 4, further comprising:
landing the diverter mandrel into a diverter housing;
connecting a tensioner to a tensioner ring; and
operating the slip joint to land the pressure control assembly onto a subsea wellhead.

6. The method of claim 1, further comprising:
deploying a drill string into a subsea wellbore through the marine riser; and
drilling the subsea wellbore using the drill string.

7. The method of claim 6,
further comprising deploying a bearing assembly to a housing of the RCD spool,
wherein the bearing assembly engages the drill string and diverts drilling returns from the marine riser to the offshore drilling unit.

8. A jumper system for assembling a marine riser, comprising:
a rotating control device (RCD) spool, comprising:
an RCD housing;
an upper adapter connected to the RCD housing and having a hose nipple; and
a lower adapter connected to the RCD housing and having a hose nipple; and
a jumper spool, comprising:
a hose;
an upper latch connected to the hose and operable to engage the upper adapter nipple; and
a lower latch connected to the hose and operable to engage the lower adapter nipple,
wherein the jumper spool further comprises:
a frame having a passage receiving the RCD housing and fastened to one of the latches;
a slider fastened to the other latch and transversely connected to the frame; and
a linear actuator operable to move the slider relative to the frame for engaging the other latch with the respective adapter nipple.

9. The jumper system of claim 8, wherein:
each adapter has a first flange, comprising:
a neck portion having a recess for receiving a seal sleeve; and
a rim portion having holes spaced therearound for receiving fasteners and a socket formed between a pair of adjacent holes, and
a collar of each hose nipple is disposed in the respective socket.

10. The jumper system of claim 9, wherein:
each collar has a shoulder formed in a lower end thereof,
each socket has a shoulder formed therein, and
each socket is oversized relative to the respective collar shoulder, thereby trapping the collar while allowing longitudinal play of the collar in the socket.

11. The jumper system of claim 9, wherein:
each collar has a seal bore formed in an inner surface thereof for receiving a respective portion of a riser auxiliary line, and
each nipple further has a catch for connection to the respective latch and having a seal bore formed in an inner surface thereof for receiving a seal sleeve of the respective latch.

12. The jumper system of claim 9, wherein:
the RCD housing has upper and lower flanges, and
each adapter has a second flange connecting the respective adapter to the respective flange of the RCD housing.

13. The jumper system of claim 8, wherein each latch comprises:
a fastener for connecting the hose to the respective nipple in an engaged position;
a lock movable between a locked position and an unlocked position, the lock keeping the fastener engaged in the locked position; and
an actuator connected to the lock and operable to move the lock from the locked position to the unlocked position.

14. The jumper system of claim 13, wherein the jumper spool further comprises a microcontroller in communication with the linear actuator and each latch actuator.

15. The jumper system of claim 8, wherein the RCD spool further comprises a latch for fastening a protector sleeve to the RCD housing in an idle mode and fastening a bearing assembly to the RCD housing in an operating mode.

16. The jumper system of claim 15, further comprising the bearing assembly, comprising:
a stripper seal for receiving and sealing against a tubular;
a bearing for supporting rotation of the stripper seal relative to the RCD housing;

a retainer for connecting the stripper seal to the bearing; and a catch sleeve for engagement with the RCD latch.

17. A jumper system for assembling a marine riser, comprising:

a rotating control device (RCD) spool, comprising:

an RCD housing;

an upper adapter connected to the RCD housing and having a hose nipple; and a lower adapter connected to the RCD housing and having a hose nipple; and a jumper spool, comprising:

a hose;

an upper latch connected to the hose and operable to engage the upper adapter nipple; and a lower latch connected to the hose and operable to engage the lower adapter nipple, wherein:

each adapter has a first flange, comprising:

a neck portion having a recess for receiving a seal sleeve; and a rim portion having holes spaced therearound for receiving fasteners and a socket formed between a pair of adjacent holes, and a collar of each hose nipple is disposed in the respective socket.

18. The jumper system of claim 17, wherein:

each collar has a shoulder formed in a lower end thereof, each socket has a shoulder formed therein, and each socket is oversized relative to the respective collar shoulder, thereby trapping the collar while allowing longitudinal play of the collar in the socket.

19. The jumper system of claim 17, wherein:

each collar has a seal bore formed in an inner surface thereof for receiving a respective portion of a riser auxiliary line, and each nipple further has a catch for connection to the respective latch and having a seal bore formed in an inner surface thereof for receiving a seal sleeve of the respective latch.

20. The jumper system of claim 17, wherein:

the RCD housing has upper and lower flanges, and each adapter has a second flange connecting the respective adapter to the respective flange of the RCD housing.

* * * * *